US007988068B2

(12) United States Patent
Mita

(10) Patent No.: US 7,988,068 B2
(45) Date of Patent: Aug. 2, 2011

(54) LIQUID EJECTION HEAD

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 1059 days.

(21) Appl. No.: 11/474,482

(22) Filed: Jun. 26, 2006

(65) Prior Publication Data

US 2006/0289672 A1 Dec. 28, 2006

(30) Foreign Application Priority Data

Jun. 27, 2005 (JP) ..... 2005-187075

(51) Int. Cl.
*B05B 1/08* (2006.01)

(52) U.S. Cl. ..... 239/102.2; 239/102.1; 347/20; 347/68; 347/70; 347/71; 347/72

(58) Field of Classification Search ..... 239/102.1, 239/102.2; 347/68, 20, 70, 71, 72
See application file for complete search history.

(56) References Cited

U.S. PATENT DOCUMENTS

| | | | | |
|---|---|---|---|---|
| 4,199,769 | A * | 4/1980 | Fischbeck | 347/48 |
| 4,455,560 | A * | 6/1984 | Louzil | 347/71 |
| 5,053,787 | A * | 10/1991 | Terasawa et al. | 347/22 |
| 5,574,486 | A * | 11/1996 | Whitlow et al. | 347/45 |
| 6,036,105 | A * | 3/2000 | Sanada et al. | 239/104 |
| 6,471,341 | B1 * | 10/2002 | Yoshimura et al. | 347/70 |
| 6,644,767 | B2 * | 11/2003 | Silverbrook | 347/11 |
| 6,824,083 | B2 * | 11/2004 | Okuda et al. | 239/548 |
| 7,104,640 | B2 * | 9/2006 | Ogura et al. | 347/86 |
| 7,399,050 | B2 * | 7/2008 | Andrews | 347/20 |
| 2001/0001458 | A1 * | 5/2001 | Hashizume et al. | 216/2 |
| 2002/0050533 | A1 * | 5/2002 | Hirota et al. | 239/102.2 |
| 2003/0063171 | A1 * | 4/2003 | Otsuka et al. | 347/94 |
| 2004/0001121 | A1 | 1/2004 | Kameda et al. | |
| 2004/0001123 | A1 * | 1/2004 | Yamaguchi | 347/70 |
| 2005/0068376 | A1 * | 3/2005 | Sugahara | 347/68 |

FOREIGN PATENT DOCUMENTS

| | | | |
|---|---|---|---|
| JP | 3-159279 | A | 7/1991 |
| JP | 8-184520 | A | 7/1996 |
| JP | 9-141865 | A | 6/1997 |
| JP | 2000-203015 | A | 7/2000 |
| JP | 2004-17315 | A | 1/2004 |

OTHER PUBLICATIONS

Japanese Office Action issued Nov. 16, 2010 in corresponding Japanese Patent Application No. 2005-187075 (with English translation).

* cited by examiner

*Primary Examiner* — Dinh Q Nguyen
*Assistant Examiner* — Trevor E McGraw
(74) *Attorney, Agent, or Firm* — Birch, Stewart, Kolasch & Birch, LLP

(57) ABSTRACT

The liquid ejection head comprises: a pressure chamber which is connected to a nozzle; a diaphragm which constitutes one face of the pressure chamber; and a piezoelectric element which deforms the diaphragm for ejecting liquid inside the pressure chamber through the nozzle, wherein the liquid is ejected by driving the piezoelectric element in a temperature region in which a tendency of increase or decrease in viscosity of the liquid with respect to temperature of the liquid and a tendency of increase or decrease in a piezoelectric d constant of the piezoelectric element with respect to temperature of the piezoelectric element have a prescribed relationship.

10 Claims, 9 Drawing Sheets

LIQUID EJECTION HEAD

BACKGROUND OF THE INVENTION

1. Field of the Invention

The present invention relates to a liquid ejection head, more particularly to a liquid ejection head using a piezoelectric element as a pressure generating device for ejecting liquid, in order that liquid is ejected stably.

2. Description of the Related Art

As an image forming apparatus, an inkjet printer (inkjet recording apparatus) is known, which comprises an inkjet head (liquid ejection head) having an arrangement of a plurality of nozzles (ejection ports) for ejecting ink (liquid) and which forms images on a recording medium by ejecting ink from the nozzles toward the recording medium, while causing the inkjet head and the recording medium to move relatively to each other.

For example, as an ink ejection method for a inkjet recording apparatus of this kind, a piezoelectric method is known, in which a piezoelectric element is used as a pressure generating device for ejecting ink and a diaphragm which constitutes one face of a pressure chamber is deformed by the deformation of the piezoelectric element, thereby changing the volume of the pressure chamber. Consequently, ink is introduced into the pressure chamber from an ink supply passage when the volume of the pressure chamber is increased, and the ink inside the pressure chamber is ejected from a nozzle in the form of an ink droplet when the volume of the pressure chamber is decreased.

A piezoelectric element has, for example, a piezoelectric body made of lead zirconate titanate ($Pb(Zr,Ti)O_3$ (PZT)) formed in a thin plate shape, and electrodes arranged on both surfaces of the piezoelectric body. The piezoelectric body is deformed when a voltage is applied between the electrodes. It is known that the characteristics of a piezoelectric body of this kind change with temperature. On the other hand, the viscosity of the ejected ink also changes greatly with temperature.

If a piezoelectric element is continuously driven in order to continuously eject ink when an image is formed, then the piezoelectric element is gradually heated. Therefore, when an image is formed by means of an inkjet recording apparatus, the temperature state of the inkjet head changes continually and hence the characteristics of the piezoelectric element and the viscosity of the ink change continually. Consequently, there has been a possibility that it is difficult to eject a uniform volume of ink stably, at all times. Moreover, in the case of apparatuses other than an inkjet recording apparatus, for example, a pressure sensor based on a piezoelectric element, since the characteristics of the piezoelectric element change with temperature, it is difficult to achieve uniform measurement and uniform control independently of the temperature.

In view of this, various proposals have been made for apparatuses using piezoelectric elements in order to achieve stable measurement and control, regardless of the temperature.

For example, Japanese Patent Application Publication No. 8-184520 discloses a pressure sensor which comprises a piezoelectric body that outputs determination signals in accordance with displacement of a pressure receiving rod provided inside a casing body. In the pressure sensor, a relationship whereby the thermal expansivity of the pressure receiving rod declines with respect to the thermal expansivity of the casing body is established on the basis of the temperature characteristics of the piezoelectric body. In this way, change in the piezoelectric constant is cancelled out and determination signals which are independent of the temperature are stably output.

Furthermore, for example, Japanese Patent Application Publication No. 2000-203015 discloses an apparatus which comprises an identification device for identifying the characteristics corresponding to a piezoelectric constant of a piezoelectric element of a print head, and a temperature determination device which determines the ambient temperature of the print head. In the apparatus, the drive voltage of the print head is determined and controlled on the basis of the piezoelectric constant characteristics obtained by the identification device and the temperature determined by the temperature determination device, in such a manner that the ink ejection volume is kept uniform.

However, the method described in Japanese Patent Application Publication No. 8-184520 is a method of compensating for the temperature of the piezoelectric body in a pressure sensor, and it performs the compensation by using coefficients of thermal expansion of the casing and the rod as parameters. Therefore, it is difficult to apply this method to a liquid ejection head.

Moreover, the method described in Japanese Patent Application Publication No. 2000-203015 determines the temperature of the apparatus and compensates the voltage applied to the piezoelectric element. Therefore, it requires a temperature determination system, the load on the driver is increased, the device has redundancy, and the costs are high. Furthermore, in particular, in the case of a multi-nozzle line type inkjet head, the head itself is large in size. Consequently, when this method is used in an inkjet head, temperature variation can occur in the head according to positions, and therefore it is difficult to perform the compensation completely.

SUMMARY OF THE INVENTION

The present invention has been contrived in view of the foregoing circumstances, an object thereof being to provide a liquid ejection head where liquid can be stably ejected independently of the temperature, temperature determination is not necessarily required, and/or the load on the drive circuit can be reduced.

In order to attain the aforementioned object, the present invention is directed to a liquid ejection head, comprising: a pressure chamber which is connected to a nozzle; a diaphragm which constitutes one face of the pressure chamber; and a piezoelectric element which deforms the diaphragm for ejecting liquid inside the pressure chamber through the nozzle, wherein the liquid is ejected by driving the piezoelectric element in a temperature region in which a tendency of increase or decrease in viscosity of the liquid with respect to temperature of the liquid and a tendency of increase or decrease in a piezoelectric d constant of the piezoelectric element with respect to temperature of the piezoelectric element have a prescribed relationship.

According to this aspect of the invention, it is possible to eject liquid stably, regardless of the temperature, while the load on the drive circuit can be reduced and the need for temperature determination can be dispensed with.

Preferably, the prescribed relationship is a relationship that the tendency of the viscosity of the liquid with respect to temperature of the liquid and the tendency of the piezoelectric d constant of the piezoelectric element with respect to temperature of the piezoelectric element both increase or decrease.

According to this aspect of the invention, for example, by ejecting liquid in the temperature region where both of the tendencies of increase or decrease tend to decline, then the increase in the liquid ejection volume caused by decrease in the liquid viscosity is cancelled out by the decrease in the drive characteristics of the piezoelectric element, and hence it is possible to stabilize the liquid ejection volume, regardless of the temperature.

Preferably, the temperature region in which the prescribed relationship is achieved is of not lower than a temperature at which the piezoelectric d constant of the piezoelectric element becomes a maximum value in temperature dependency of the piezoelectric d constant of the piezoelectric element.

According to this aspect of the invention, it is possible to adjust the tendencies of increase or decrease so that both the tendencies of increase or decrease have commonality. It is possible further to reduce the load on the drive circuit by reducing the temperature at which the piezoelectric d constant becomes a maximum by selecting the material used for the piezoelectric element.

Preferably, the temperature region is from a temperature not lower than the temperature at which the piezoelectric d constant of the piezoelectric element becomes the maximum value, through a temperature not exceeding a lower one of a Curie point of the piezoelectric element and a boiling point of the liquid.

According to this aspect of the invention, it is possible to stabilize the liquid ejection characteristics, without determining and controlling the temperature precisely.

Preferably, change in ejection characteristics due to change in temperature of the liquid is compensated according to at least one of a parameter of change in rigidity of the diaphragm due to change in temperature of the diaphragm and a parameter of change in a relative dielectric constant of the piezoelectric element due to change in temperature of the piezoelectric element.

According to this aspect of the invention, for example, even if it is difficult to completely achieve the compensation by means of controlling the temperature to the aforementioned temperature range alone, then it is possible to stabilize the ejection characteristics by taking other parameters into account.

Preferably, the liquid ejection head further comprises a temperature control device which keeps the temperature of the piezoelectric element and the temperature of the liquid within the temperature region in which the prescribed relationship is achieved.

According to this aspect of the invention, it is possible to reduce the load on the drive circuit and to stabilize the liquid ejection characteristics regardless of the temperature.

As described above, according to the present invention, it is possible to eject liquid stably, regardless of the temperature, while the load on the drive circuit is reduced and the need for temperature determination is dispensed with.

BRIEF DESCRIPTION OF THE DRAWINGS

The nature of this invention, as well as other objects and benefits thereof, are explained in the following with reference to the accompanying drawings, in which like reference characters designate the same or similar parts throughout the figures and wherein.

DETAILED DESCRIPTION OF THE PREFERRED EMBODIMENTS

Figure 1:
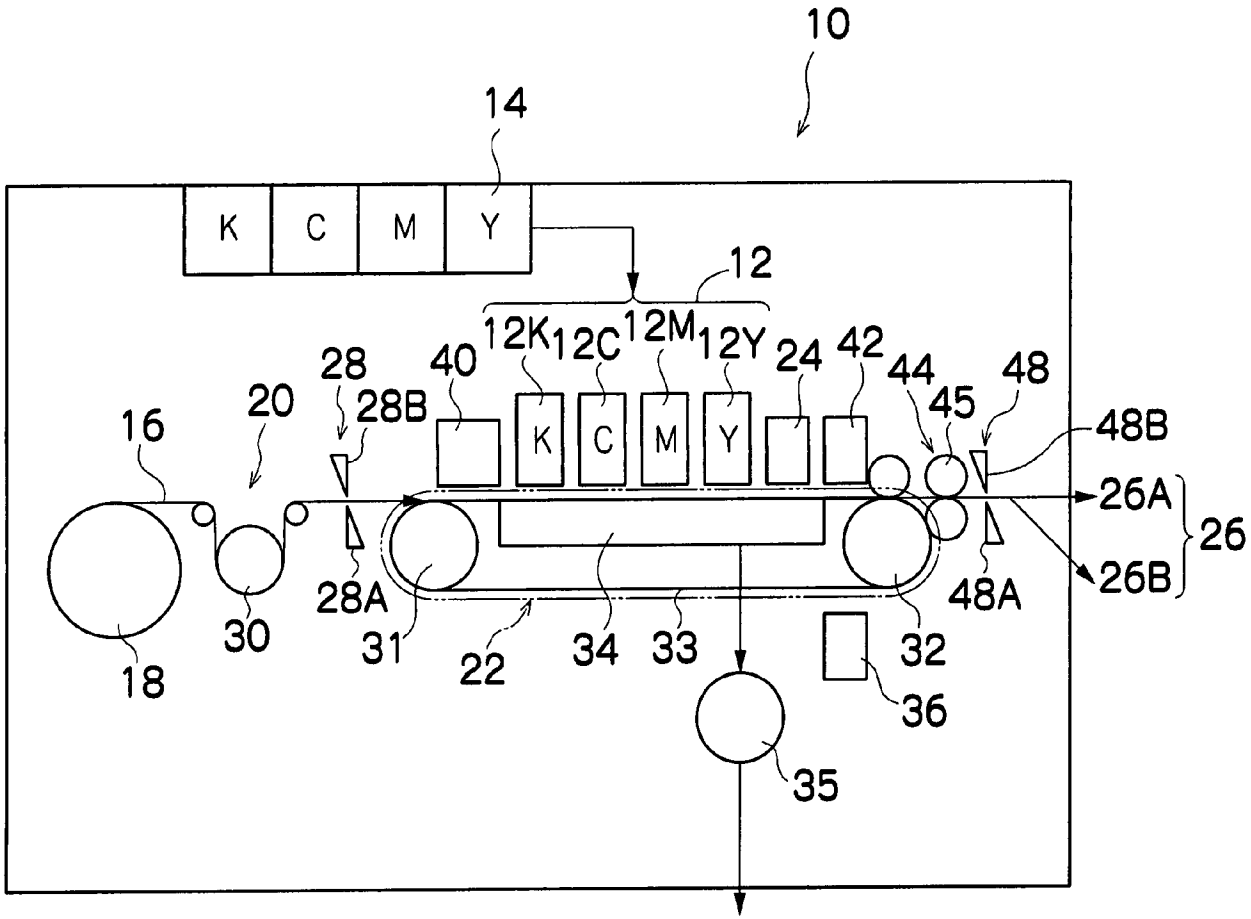
FIG. 1 is a general schematic drawing showing an approximate view of a first embodiment of an inkjet recording apparatus forming an image forming apparatus having a liquid ejection head according to an embodiment of the present invention.

FIG. 1 is a general schematic drawing showing an approximate view of a first embodiment of an inkjet recording apparatus which is an image forming apparatus having a liquid ejection head according to an embodiment of the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (shown in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on before the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
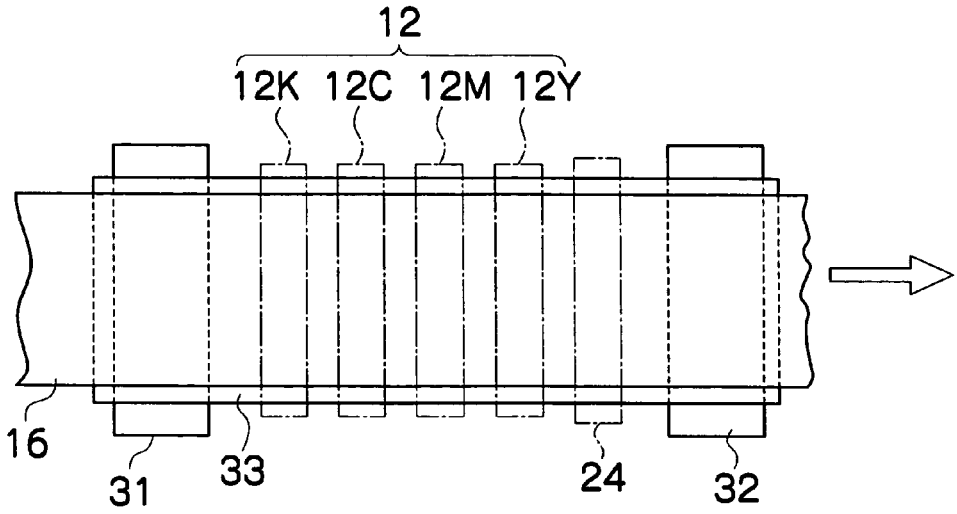
FIG. 2 is a plan view of the principal part of the peripheral area of a print unit in the inkjet recording apparatus illustrated in FIG. 1.

The print unit 12 is a so-called "full line head" in which a line head having a length corresponding to the maximum paper width is arranged in a direction (main-scanning direction) that is perpendicular to the paper conveyance direction (sub-scanning direction) (see FIG. 2). 15 As shown in FIG. 2, each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (left side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main-scanning direction) that is perpendicular to the paper conveyance direction.

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while the full-line head and the recording paper are moved relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (such as a display device and an alarm sound generator) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Figure 3:
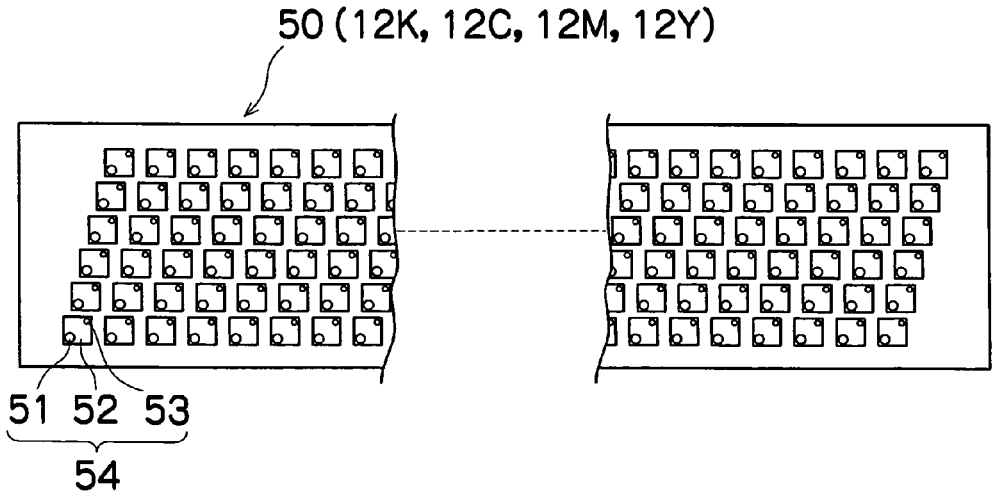
FIG. 3 is a plan perspective diagram showing an embodiment of the structure of a print head.

Next, the arrangement of nozzles (liquid ejection ports) of a print head (liquid ejection head) is described below. The print heads 12K, 12C, 12M and 12Y of the respective ink colors have the same structure, and a reference numeral 50 is hereinafter designated to any of the print heads. FIG. 3 is a plan perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

There are no particular limitations on the size of the nozzle arrangement in a print head 50 of this kind, but as one embodiment, the nozzle density of 2400 nozzles per inch (npi) can be achieved by arranging nozzles 51 in 48 lateral rows (in 21 mm) and 600 vertical columns (in 305 mm).

In the embodiment shown in FIG. 3, the pressure chambers 52 each have an approximately square planar shape when viewed from above, but the planar shape of the pressure chambers 52 is not limited to a square shape. As shown in FIG. 3, the nozzle 51 is formed at one end of the diagonal of each pressure chamber 52, and an ink supply port 53 is provided at the other end thereof.

Figure 4:
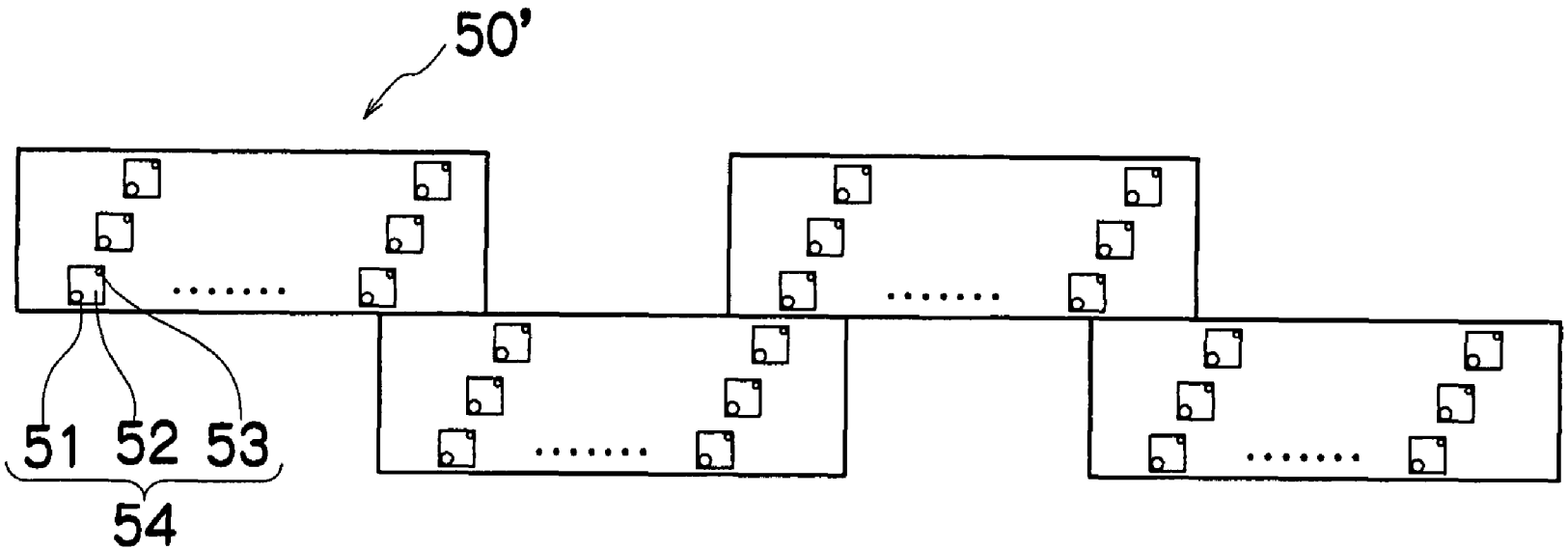
FIG. 4 is a plan view showing another embodiment of the print head.

Moreover, FIG. 4 is a plan view perspective diagram showing a further embodiment of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
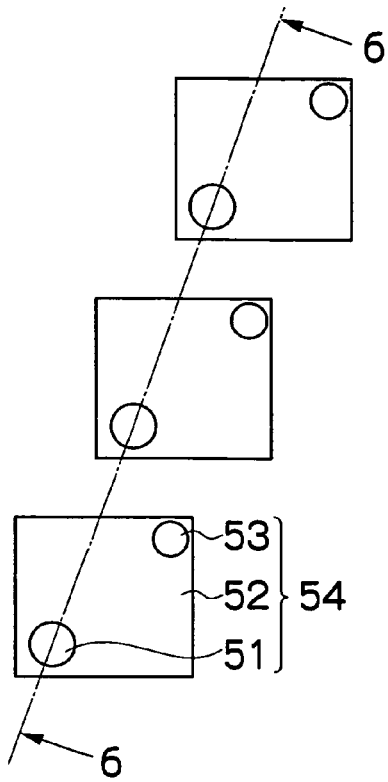
FIG. 5 is a plan diagram showing an enlarged view of the pressure chambers unit shown in FIG. 3.

FIG. 5 shows an enlarged view of the pressure chamber unit 54 in FIG. 3. Moreover, FIG. 6 shows a cross-sectional diagram of the pressure chamber unit 54 along line 6-6 in FIG. 5.

Figure 6:
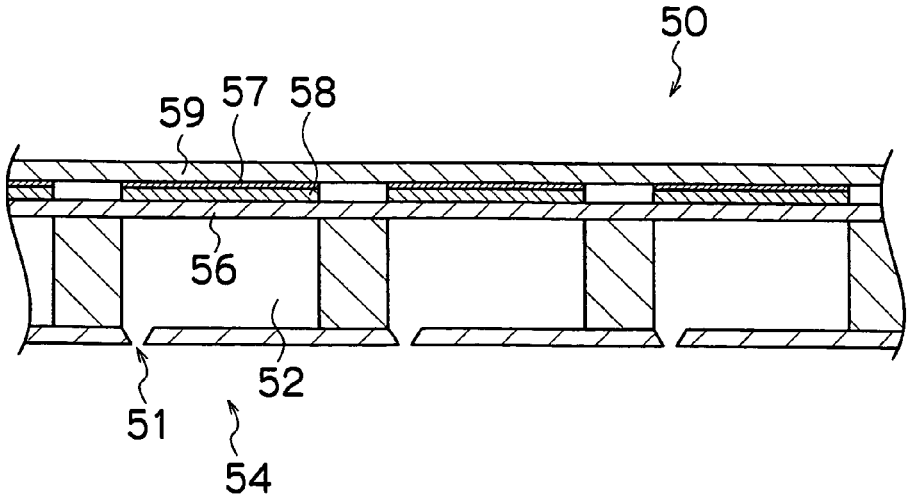
FIG. 6 is a cross-sectional diagram along line 6-6 in FIG. 5.

FIG. 6 shows a cross-sectional diagram of the composition of the pressure chamber unit 54 in the print head 50 according to the first embodiment of the present invention.

As shown in FIG. 6, each pressure chamber unit 54 comprises the pressure chamber 52 connected to the nozzle 51 from which ink is ejected, and a common flow channel (not shown in FIG. 6) which supplies ink via the supply port 53 is connected to the pressure chamber 52. One face of the pressure chamber 52 (in FIG. 6, the upper face) is constituted by a diaphragm 56.

A piezoelectric body 58 is formed over a portion of the diaphragm 56 reverse to a portion adjacent to the pressure chamber 52 (namely, on the upper surface of the diaphragm 56), and an individual electrode 57 for applying a drive voltage for driving the piezoelectric body 58 is formed on top of the piezoelectric body 58. The diaphragm 56 also serves as a common electrode for the individual electrode 57. The piezoelectric body 58 constitutes a piezoelectric element by being sandwiched between the common electrode (diaphragm 56) and the individual electrode 57, and when a voltage is applied between the common electrode (diaphragm 56) and the individual electrode 57, the piezoelectric body 58 is deformed, and applies an ejection pressure to the ink inside the pressure chamber 52.

In the present embodiment, a flexible heater 59 is provided on the upper side of the piezoelectric body 58 on which the individual electrode 57 has been formed. As described hereinafter in detail, the flexible heater 59 is used for temperature control in such a manner that the piezoelectric body 58 is driven at a temperature equal to or exceeding the temperature at which the d constant of the piezoelectric body 58 becomes a maximum according to the temperature dependency of the d constant of the piezoelectric body 58. The flexible heater 59 is made of materials such as rubber and carbon, and it is deformable in accordance with the deformation of the piezoelectric body 58, in such a manner that it does not impede the deformation of the piezoelectric body 58.

Figure 7:
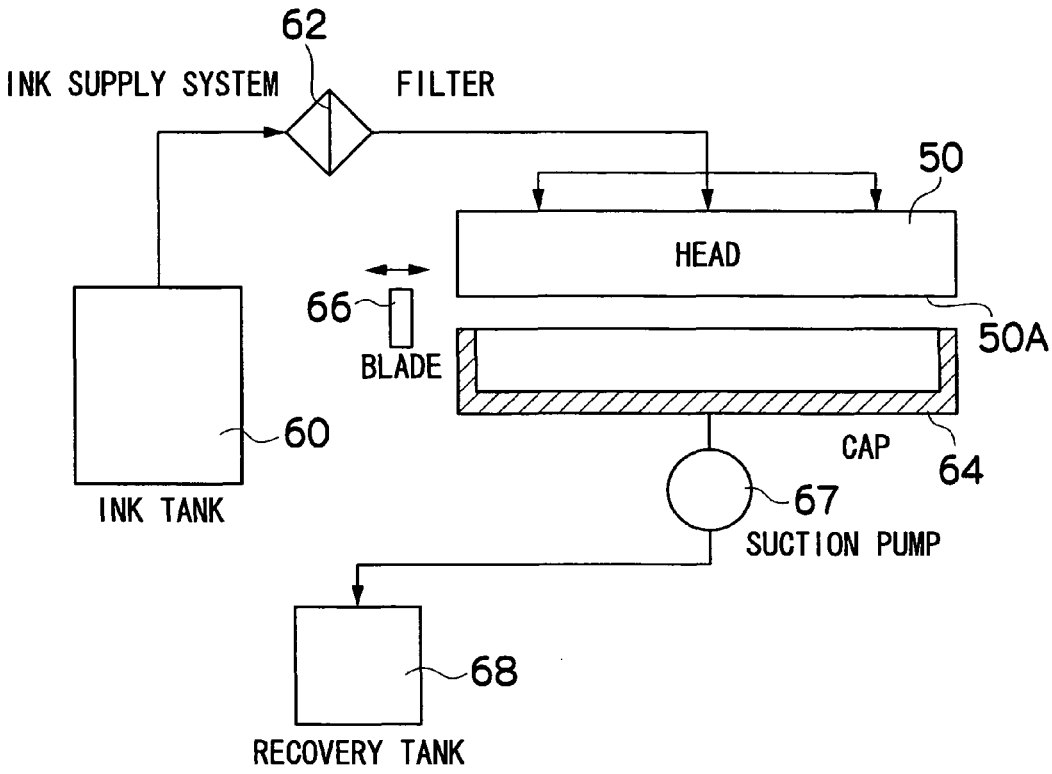
FIG. 7 is a schematic drawing showing the composition of an ink supply system in the inkjet recording apparatus.

FIG. 7 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 7 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 7. The filter mesh size in the filter 62 is preferably equivalent to or less than the diameter of the nozzle of the print head 50 and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power is turned OFF or when in a print standby state, the cap 64 is raised to a predetermined elevated position by the elevator mechanism so as to come into close contact with the print head 50, and the nozzle face 50A of the nozzle region is thereby covered with the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by the suction is sent to a recovery tank 68. This suction operation is also carried out in order to suction and remove degraded ink which has hardened due to increasing in viscosity when ink is loaded into the print head for the first time, and when the print head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the pressure generating devices (piezoelectric elements) for driving ejection are operated. Therefore, before a state of this kind is reached (while the ink is in a range of viscosity which allows ink to be ejected by means of operation of the pressure generating devices), a "preliminary ejection" is carried out, whereby the pressure generating devices are operated and the ink in the vicinity of the nozzles, which is of raised viscosity, is ejected toward the ink receptacle. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed into the ink inside the nozzles 51 and the pressure chambers 52, or when the ink viscosity inside the nozzle 51 has increased to a certain level or higher, ink can no longer be ejected from the nozzles even if the laminated pressure generating devices are operated. In a case of this kind, the cap 64 is placed on the nozzle surface 50A of the print head 50, and the ink containing bubbles or the ink of increased viscosity inside the pressure chambers 52 is suctioned by a pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 illustrated in FIG. 7 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 8:
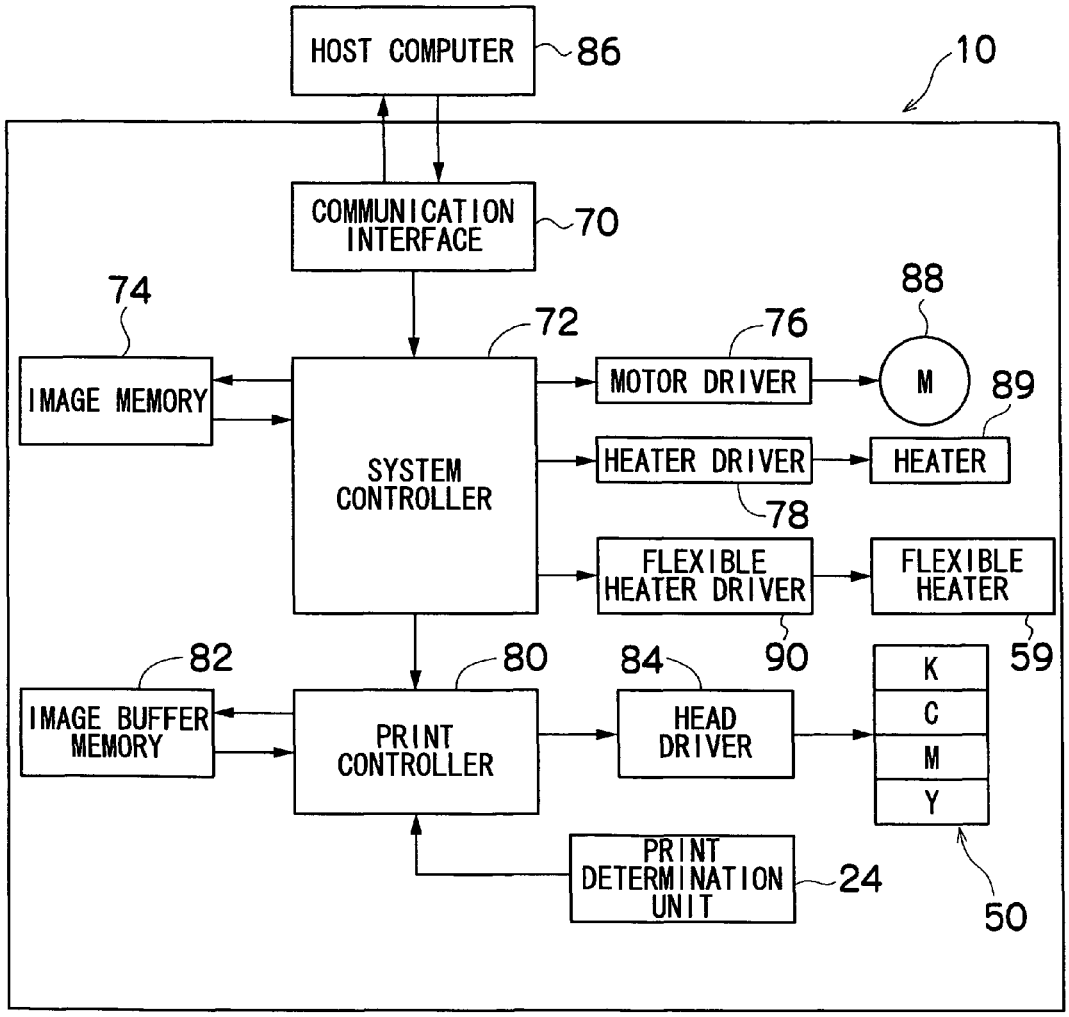
FIG. 8 is a partial block diagram showing the system composition of the inkjet recording apparatus.

FIG. 8 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

Furthermore, in the present embodiment, by driving the piezoelectric bodies 58 in the temperature region at or above the temperature at which the d constant of the piezoelectric bodies 58 reaches a maximum according to the temperature dependency of the d constant of the piezoelectric bodies 58, the ink ejection volume is stabilized, independently of the temperature. The flexible heater 59 is provided above the pressure chamber units 54 for this purpose. Furthermore, a flexible heater driver 90 is provided in order to control the flexible heater 59. The system controller 72 controls the flexible heater 59 via the flexible heater driver 90, and performs temperature control in such a manner that the piezoelectric bodies 58 are driven in a temperature region at or above the temperature at which the d constant of the piezoelectric bodies 58 reaches a maximum according to the temperature dependency of the d constant of the piezoelectric bodies 58. This control is described in detail hereinafter.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the pressure generating device of the print heads 50 of the respective colors on the basis of print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and s the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, the actions of the present embodiment are described below.

The present embodiment seeks to maintain the ink ejection volume at a uniform level, regardless of the temperature, by driving the piezoelectric bodies 58 to eject ink at a temperature equal to or greater than the temperature at which the d constant of the piezoelectric bodies 58 reaches a maximum according to the temperature dependency of the d constant of the piezoelectric bodies 58.

Furthermore, there are two types of piezoelectric elements: elements that operate in a longitudinal vibration mode (d33 mode) in which the piezoelectric elements are deformed in the same direction as the direction of the applied electric field and hence expand and contract in the axial direction; and elements that operate in a bending vibration mode (d31 mode) in which the piezoelectric elements are deformed in a direction perpendicular to the direction of the applied electric field and hence the piezoelectric elements bend. The piezoelectric bodies 58 used in the present embodiment are displaced in the d31 mode.

Figure 9:
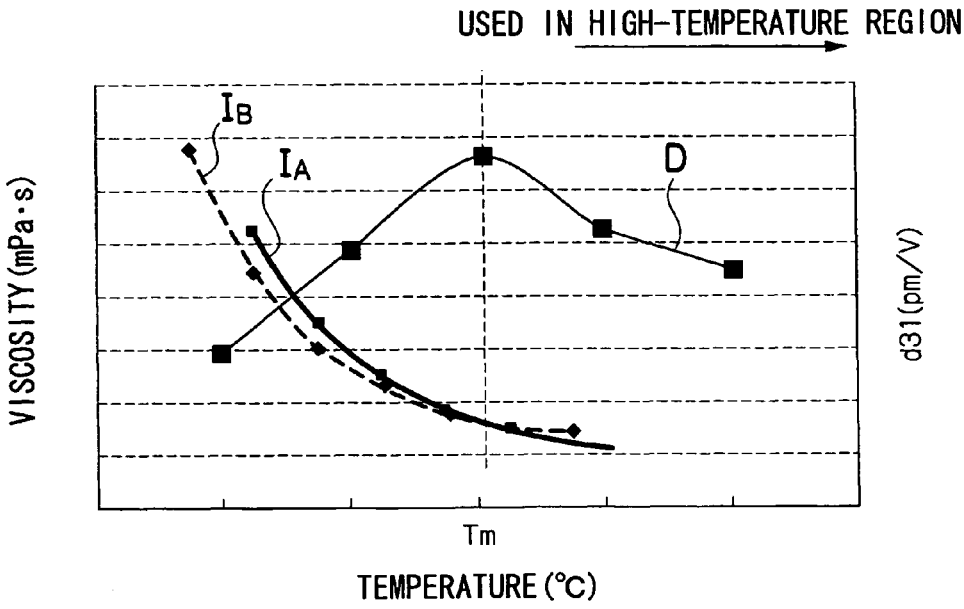
FIG. 9 shows graphs indicating the relationship between temperature and ink viscosity and the relationship between temperature and the d constant of a piezoelectric body.

The coefficient indicating the amount by which a piezoelectric element is displaced when an electric field is applied to the piezoelectric body is called the "piezoelectric d constant" (or simply the "d constant"). The piezoelectric d constant changes depending on the temperature. FIG. 9 shows a combined illustration of graphs $I_A$ and $I_B$ indicating the temperature dependency of the viscosity of two types of inks, and a graph D indicating the temperature dependency of the d constant of a piezoelectric body.

As shown by the graph D in FIG. 9, during the initial stage, the piezoelectric d constant increases with the temperature rise and reaches a maximum value at a particular temperature Tm. Thereafter, the piezoelectric d constant proceeds to decline with further increase in the temperature. In other words, the amount of deformation of the piezoelectric body declines gradually when the temperature exceeds the peak temperature Tm.

On the other hand, as revealed by the two graphs $I_A$ and $I_B$ in FIG. 9, which show the change in viscosity of two types of inks with respect to the temperature, the viscosity of ink decreases as the temperature rises. Consequently, the higher the temperature, the lower the viscosity of the ink, so that the ink becomes highly fluid and a very large volume of ink is ejected even at the same ejection pressure. Thus, assuming that the characteristics of the piezoelectric body 58 are uniform, the viscosity of the ink changes with the temperature, and hence the ink ejection volume changes in accordance with the temperature.

Furthermore, during printing, the temperature of the print head 50 changes (increases), due to the generation of heat caused by the driving of the piezoelectric bodies 58. As a result of this temperature change, the ink viscosity changes and the printing characteristics, such as the ink ejection volume, also change.

As a means of resolving this issue, the piezoelectric bodies 58 are used in a high-temperature region above the peak temperature Tm at which the d constant of the piezoelectric bodies 58 reaches a maximum value in the graph D in FIG. 9, for example. In this case, the ink viscosity declines with increase in the temperature, and the volume of ink ejected therefore tends to increase accordingly. On the other hand, according to the temperature dependency of the d constant of the piezoelectric bodies 58, the d constant of the piezoelectric bodies 58 decreases with increase in the temperature, and hence the piezoelectric bodies 58 become less readily displaceable, thus causing the ejection volume to decrease. As a result, the ejection performance of the piezoelectric bodies 58 declines with the increase in the ink ejection volume caused by the decline in the ink viscosity. Therefore, these two factors cancel each other out, a balance is created, and the ink ejection volume becomes stabilized.

In this way, in the present embodiment, by driving the piezoelectric bodies 58 in the high-temperature region above the peak temperature Tm at which the d constant of the piezoelectric bodies 58 reaches a maximum value according to the temperature dependency of the d constant of the piezoelectric bodies 58, it is possible to stabilize the ink ejection volume irrespective of change in the temperature. In this case, a temperature sensor, or the like, is not necessarily required, and it is not necessary to determine the precise temperature and to implement temperature control for compensating the temperature precisely.

In this case, the range of the temperature T during the ink ejection is the range expressed by the following inequality relating to the peak temperature Tm at which the d constant of the piezoelectric body 58 becomes a maximum value according to the temperature dependency of the d constant of the piezoelectric body 58 in FIG. 9, the Curie point (Curie temperature) $T_c$ of the piezoelectric body 58, and the boiling point (boiling temperature) $T_B$ of the ink:

$$Tm \leqq T \leqq (\text{the lower of } T_c \text{ and } T_B).$$

More specifically, the method of controlling the temperature in this way involves, for example, attaching a thermistor to a part of the flexible heater 59 described above, and controlling the flexible heater 59 under the condition of the temperature equal to or greater than the temperature Tm. Desirably, only the lower limit value and the upper limit value are monitored with the thermistor, and only operations of switching on and off of the flexible heater 59 are performed.

Furthermore, if there is a region where the ink ejection volume is not fully compensated by controlling the piezoelectric bodies 58 in such a manner that they are driven in the high-temperature region above the peak temperature Tm in this way, then other parameters apart from the above characteristics of the piezoelectric bodies 58, such as the rigidity of the diaphragm 56, namely, the Young's modulus of the diaphragm 56, and the relative dielectric constant of the piezoelectric bodies 58, may be taken into account. For example, it is possible to make combined use of the temperature characteristics of the diaphragm 56 having the diaphragm rigidity that increases or decreases in accordance with the temperature. Furthermore, the relative dielectric constant of the piezoelectric bodies 58 has a similar tendency of temperature dependence to that of the d constant, and it affects the ejection performance with respect to the electrical characteristics.

Furthermore, although there is no particular restriction on the peak temperature Tm at which the d constant of the piezoelectric body 58 reaches a maximum value according to the temperature dependency of the d constant in graph D in FIG. 9, the peak temperature Tm may be 60° C., for example. However, the temperature Tm at which the d constant of the piezoelectric characteristics d31 is a maximum value can be made lower than the peak temperature Tm value described above, by adding a substance such as $La_2O_3$, $Nd_2O_3$, $Nb_2O_5$, $Sb_2O_3$, $Bi_2O_3$, $ThO_2$, $WO_3$, or the like, to the PZT-type piezoelectric material, for example.

Next, the relationship between the ink ejection volume, and the elements relating to the d (d31) constant and the ink viscosity, is described below.

The ink ejection volume is taken to be "Vol". The unit of the ink ejection volume is picoliter (pl.) The displacement volume is taken to be "Wo", which is also expressed in unit of pl (picoliter) and is directly proportional to the piezoelectric d31 constant. The inertance of nozzle is taken to be "Mn", and the inertance of supply port is taken to be "Ms". The unit of inertance is "$kg/m^4$".

Moreover, the compliance of pressure chamber is taken to be "Cc", and the compliance of the actuator (piezoelectric elements) is taken to be "Cp". The unit of compliance is "$m^3/Pa$". Furthermore, "D" represents the attenuation of the actuator and "E" represents the frequency of the actuator. The attenuation and frequency are dependent on the ink viscosity.

In this case, the relationship between the ejection volume Vol and these variables is expressed by the following equation:

$$Vol=\{Ms/(Ms+Mn)\}\cdot\{Cc/(Cp+Cc)\}\cdot Wo\cdot\{1+exp(-\pi\cdot D/E)\}.$$

Here, if the ink viscosity becomes high, then the exponential term in the above equation approaches zero, whereas if the ink viscosity becomes low, then the exponential term approaches one.

Figure 10:
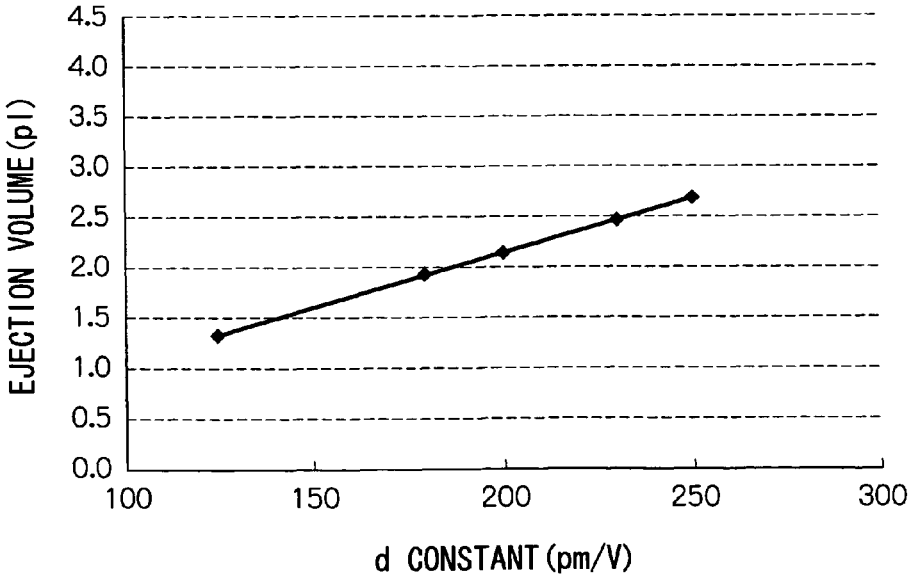
FIG. 10 is a graph showing the relationship between the d constant of the piezoelectric body and the ink ejection volume.
Figure 11:
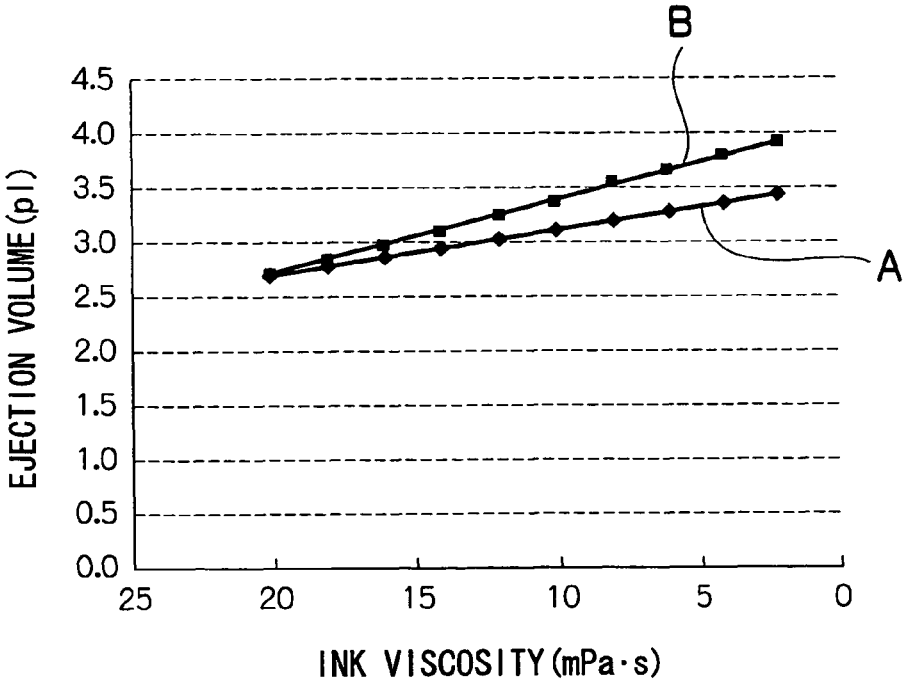
FIG. 11 is a graph showing the relationship between the ink viscosity and the ink ejection volume.

Furthermore, FIG. 10 shows the relationship between the d constant and the ejection volume. As shown in FIG. 10, the ejection volume Vol is directly proportional to the d constant. Furthermore, FIG. 11 shows the relationship between the ink viscosity and the ejection volume Vol. Graph A in FIG. 11 indicates the relationship under the same conditions as those of the graph in FIG. 10, and graph B represents a case where only the compliance Cc of pressure chamber has been changed with respect to the conditions in the graph A.

Here, it is possible to introduce the characteristics corresponding to the temperature change by suitably setting (establishing) the parameters relating to the four factors of the print head 50, namely, the nozzle inertance Mn ($kg/m^4$), the supply port inertance Ms ($kg/m^4$), the pressure chamber compliance Cc ($m^3/Pa$) and the actuator (piezoelectric element) compliance Cp ($m^3/Pa$).

Figure 12:
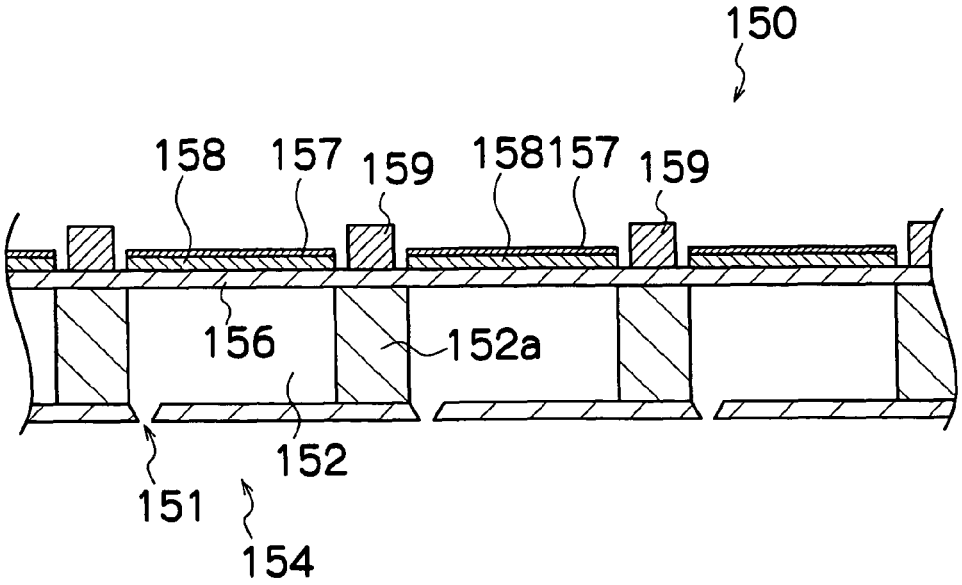
FIG. 12 is a cross-sectional diagram showing the general composition of a pressure chamber unit in a print head according to a second embodiment of the present invention.

FIG. 12 shows a cross-sectional diagram of the general composition of a print head (liquid ejection head) according to a second embodiment of the present invention.

As shown in FIG. 12, similarly to the print head 50 according to the first embodiment shown in FIG. 6, in the print head 150 according to the second embodiment, each of pressure chamber units 154 is formed by means of a pressure chamber 152 connected to a nozzle 151 from which ink is ejected, and a common flow channel (not shown) which supplies ink via a supply port 153 is connected to the pressure chamber 152. Furthermore, one face of the pressure chambers 152 is constituted by a diaphragm 156.

A piezoelectric body 158 is formed on a surface of the diaphragm 156 reverse to the portion corresponding to the pressure chamber 152, and an individual electrode 157 for applying a drive voltage for driving the piezoelectric body 158 is formed on top of the piezoelectric body 158. The diaphragm 156 also serves as a common electrode, which is in combination with the individual electrode 157. The piezoelectric body 158 constitutes a piezoelectric element by being sandwiched between the common electrode (diaphragm 156) and the individual electrode 157, and when a voltage is applied between the common electrode (diaphragm 156) and the individual electrode 157, the piezoelectric body 158 is deformed, and applies an ejection pressure to the ink inside the pressure chamber 152.

In the present embodiment, a flexible heater 159 is provided on top of the diaphragm 156, above partitions 152*a* of the pressure chambers 152 and between the piezoelectric bodies 158.

Figure 13:
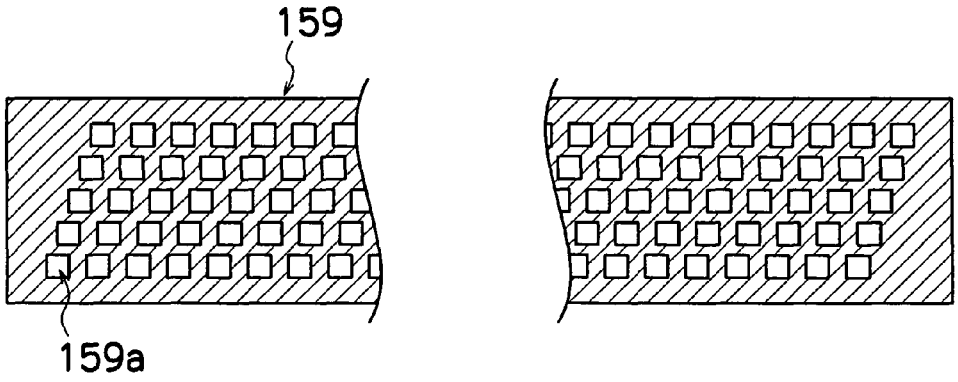
FIG. 13 is a plan diagram showing a flexible heater according to the second embodiment of the present invention.

FIG. 13 shows a plan diagram of the flexible heater 159. As shown in FIG. 13, the flexible heater 159 is formed so as to cover the whole of the print head 150, similarly to the diaphragm 156 (see FIG. 12), and holes 159*a* are provided in the flexible heater 159 in the positions corresponding to the piezoelectric bodies 158, and thereby the flexible heater 159 avoids the piezoelectric bodies 158 (see FIG. 12).

In this way, the flexible heater 159 according to the present embodiment heats the diaphragm 156 and the pressure chamber partitions 152*a*, and serves to control the temperature of the print head 150 to a higher temperature than the peak temperature Tm of the piezoelectric bodies 158 on the basis of the temperature dependency of the d constant of the piezoelectric bodies (see FIG. 9), in such a manner that the piezoelectric bodies 158 are driven in this temperature range.

Figure 14:
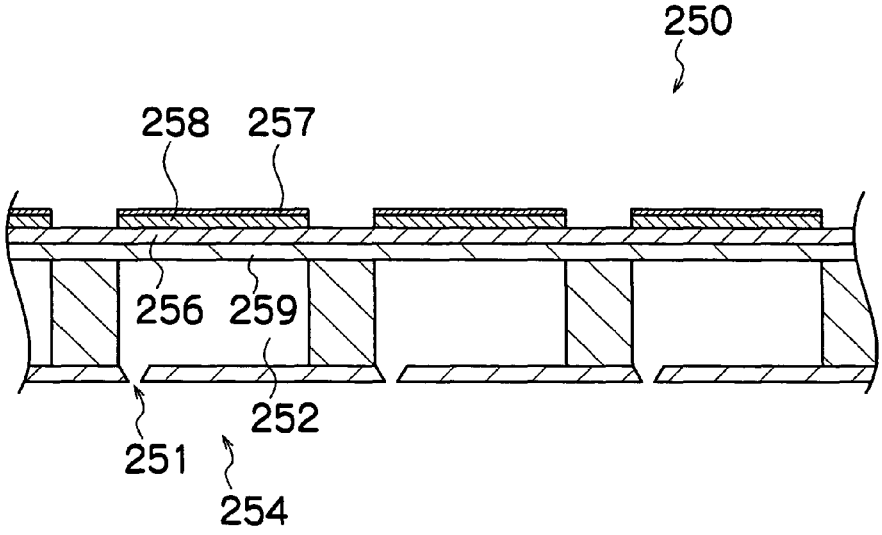
FIG. 14 is a cross-sectional diagram showing the general composition of a pressure chamber unit in a print head according to a third embodiment of the present invention.

FIG. 14 shows a cross-sectional diagram of the general composition of a print head (liquid ejection head) according to a third embodiment of the present invention.

As shown in FIG. 14, similarly to the print head 50 according to the first embodiment shown in FIG. 6, in the print head 250 according to the third embodiment, each of pressure chamber units 254 is formed by means of a pressure chamber 252 connected to a nozzle 251 from which ink is ejected, and a common flow channel (not shown) which supplies ink via a supply port 253 is connected to the pressure chamber 252. Furthermore, a diaphragm 256 is provided on the upper side of the pressure chambers 252, piezoelectric bodies 258 are formed on top of the diaphragm 256, and individual electrodes 257 are formed on the piezoelectric bodies 258.

In the present embodiment, a ceramic heater 259 is provided so as to form the ceilings of the pressure chambers 252, on the same side as the pressure chambers 252 in terms of the diaphragm 256.

The ceramic heater 259 is formed so as to cover the whole of the print head 250 in a single sheet, similarly to the diaphragm 256. The ceramic heater 259 heats up the whole of the print head 250, and it is also deformable in accordance with the deformation of the diaphragm 256.

As described above, there are various methods for controlling the temperature of the print head, but whatever the method used, the piezoelectric bodies are driven in the high-temperature region above the peak temperature Tm of the piezoelectric bodies according to the temperature dependency of the d constant of the piezoelectric bodies. More specifically, in this temperature range, both the ink viscosity and the d constant of the piezoelectric bodies with respect to the temperature tend to decrease (both fall toward the right-hand side in the graphs in FIG. 9). With increase in the temperature, the ink viscosity declines and the ink ejection volume increases, but at the same time, the drive characteristics of the piezoelectric bodies decline, and hence these factors cancel each other out. Consequently, the ink ejection volume remains stable regardless of the temperature.

Furthermore, as described above, desirably, the temperature range of temperature control ranges from a temperature equal to or greater than the peak temperature of the piezoelectric bodies according to the temperature dependency of the d constant, to a temperature not exceeding the lower one of the boiling point of the ink and the Curie point of the piezoelectric bodies.

The temperature control range is not necessarily limited only to a range in which the ink viscosity and the d constant according to the temperature dependency of the d constant of the piezoelectric bodies both tend to decrease (fall toward the right) in relation to temperature rise, as in the embodiment described above. For instance, depending on the type of ink used, and the like, it may also be possible to control the temperature to a range where both of these factors tend to increase (rise toward the right).

The liquid ejection head according to the present invention has been described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a pressure chamber which is connected to a nozzle;

diaphragm which constitutes one face of the pressure chamber;

a piezoelectric element which deforms the diaphragm for ejecting liquid inside the pressure chamber through the nozzle;

an electrode for applying a drive voltage to the piezoelectric element;

a heater that controls temperature of said liquid ejection head; and a partition separating the pressure chamber from an adjacent pressure chamber, wherein the heater is disposed opposite to the partition through the diaphragm, and the heater controls the temperature so that the liquid is ejected by driving the piezoelectric element in a temperature region between a first limit temperature and a second limit temperature higher than the first limit temperature, the first limit temperature being, not lower than a temperature at which the piezoelectric d constant of the piezoelectric element becomes a maximum value, and the second limit temperature not exceeding a lower one of a Curie point of the piezoelectric element and a boiling point of the liquid.

2. The liquid ejection head as defined in claim 1, wherein the heater controls temperature such that a change in ejection characteristics due to change in temperature of the liquid is compensated according to at least one of a parameter of change in rigidity of the diaphragm due to change in temperature of the diaphragm and a parameter of change in a relative dielectric constant of the piezoelectric element due to change in temperature of the piezoelectric element.

3. The liquid ejection head of claim 1, wherein said heater is a flexible heater positioned above said piezoelectric element.

4. The liquid ejection head of claim 1, wherein said heater includes a flexible heater element positioned between the pressure chamber and an adjacent pressure chamber.

5. The liquid ejection head of claim 1, wherein said liquid ejection head is a line-type ejection head for printing a line of ink, said liquid ejection head including a series of pressure chambers, said heater including a plurality of flexible heater elements positioned between adjacent pressure chambers of said liquid ejection head.

6. The liquid ejection head of claim 1, wherein a decreasing d constant of the piezoelectric element decreases deformation of the piezoelectric element to stabilize ink ejection volume at high temperatures.

7. The liquid ejection head of claim 1, further comprising a heater driver for controlling the heater.

8. The liquid ejection head according to claim 1, wherein the diaphragm forms an entirety of the one face of the pressure chamber.

9. The liquid ejection head according to claim 1, wherein the heater is disposed in direct and pressing contact with the electrode.

10. The liquid ejection head according to claim 1, wherein the piezoelectric element is in immediate contact with the diaphragm.

* * * * *